US005183224A

United States Patent [19]

Harburg

[11] Patent Number: 5,183,224

[45] Date of Patent: Feb. 2, 1993

[54] SELF REGULATING PINWHEEL KITE TAIL

[76] Inventor: Rudy W. Harburg, 1020 Mapleton Ave., Boulder, Colo. 80304

[21] Appl. No.: 522,810

[22] Filed: May 14, 1990

[51] Int. Cl.[5] ..... B64C 31/06; A63H 27/08

[52] U.S. Cl. ..... 244/155 R; 244/153 R

[58] Field of Search ..... 244/153 R, 153 A, 155 R, 244/155 A; 446/217, 218

[56] References Cited

U.S. PATENT DOCUMENTS

| | | | |
|---|---|---|---|
| 1,352,674 | 9/1920 | Mitchel | 446/218 |
| 1,639,943 | 8/1927 | Heberling | 446/217 |
| 2,208,786 | 7/1940 | Astle | 244/153 R |
| 2,768,473 | 10/1956 | Taggart | 446/217 |
| 3,055,622 | 9/1962 | Harmon | 244/153 R |
| 3,335,985 | 8/1967 | Neal | 244/153 R |
| 3,806,073 | 4/1974 | Christie | 244/155 R |
| 3,861,626 | 1/1975 | Hufstader | 244/153 R |
| 3,936,020 | 2/1976 | Jackson | 244/153 R |
| 3,941,504 | 3/1976 | Snarbach | 446/217 |
| 3,994,454 | 11/1976 | Worsham | 244/153 R |
| 4,084,102 | 4/1978 | Fry et al. | 244/153 R |
| 4,767,373 | 8/1988 | Antonio | 446/217 |
| 4,770,132 | 10/1988 | Stoecklin et al. | 244/155 R |

FOREIGN PATENT DOCUMENTS

| | | | |
|---|---|---|---|
| 0404525 | 12/1909 | France | 244/153 R |
| 0958172 | 3/1950 | France | 244/153 R |

*Primary Examiner*—Joseph F. Peters, Jr.
*Assistant Examiner*—Virna L. Ansley

[57] ABSTRACT

A swivel on a string is attached to the windward face of a pinwheel turbine. The other end of the string is attached to the aft portion of a kite thus creating a kite tail. Wind against its veins and leeward parts stabilize the pinwheel's orientation and cause it to spin. The pinwheel is light but tends to produce drag proportional to the velocity of the wind, thereby, stabilizing the kite in both low winds and high winds. A multiplicity of pinwheels can be attached in series on one kite tail, and one or more such kite tails can be attached to a kite to provide directional stability. This self-regulating tail can be used to help keep a kite airborne in an extremely wide range of wind speeds.

8 Claims, 8 Drawing Sheets

4a.

4.b 4.c.

4.d.

4.e.

SELF REGULATING PINWHEEL KITE TAIL

BACKGROUND

1. Field of Invention

This invention relates to an improved rotating kite tail for stabilizing a kite in flight.

2. Discussion of Prior Art

A variety of rotating kite tails have existed for many years. Descriptions of rotating kite tails can be found in kite catalogs such as Into the Wind 1990 Kite Catalog, 1408 Pearl Street, Boulder, Colo. 80302, and in the Penguin Book of Kites, David Pelham Penguin Books, 625 Madison Ave. NY, N.Y. 10022.

Elongated helix tails, multi-tethered parachute shaped tails, rotating elongated wind socks, and multi-tethered elongated rotating drogue type kite tails are currently available. Rotating kite tails such as these rotate faster in higher winds. Faster rotation creates greater wind friction and drag. In this sense these kite tails are self-regulating. Multi-tethering and elongation provide the tail with directional stability. But in terms of the aerodynamics and economics of kites, multi-tethering and elongation are expensive and heavy. Kite flyers want to minimize their costs but they also want their kite to fly in as wide a range of winds as possible. A lighter, simpler, more wind responsive, higher r.p.m. rotating kite tail is needed.

U.S. Pat. No. 3,806,073 was issued to Jay. D. Christie for a kite tail that heretofor most closely addressed this need. However, Christie's kite tail utilized elongated helical fins or a combination of fins and rudders to create the aerodynamics that cause the tail to rotate and self regulate.

Elongated helical fins are relatively heavy and complex, and Christie's fin and rudder arrangement is designed in such a way that the rudders tend to flatten out and loose effectiveness in high winds unless these fins and rudders are constructed of relatively heavy, expensive material.

U.S. Pat. No. 4,778,132 was issued to Carl E. Stoecklin and John F. Stoecklin for mounting a pinwheel to a kite. A pinwheel does provide efficient rotational drag, however, the Stoecklins' did not provide for the pinwheel to trail off in the wind leeward the kite. It is the leeward tug on the aft portion of a kite, or multiple leeward tugs symmetrical about the center spine of a kite that give a kite lateral pitch stability.

Thus the Stoecklins' invention is not effective in the way a self regulating rotational kite tail is effective. U.S. Pat. No. 1,352,674 was issued to C.F. Mitchel for pinwheels. However Mitchel's pinwheel is not assembled in a manner that allows it to elongate proportional to the velocity of the wind. The windward and leeward faces of Mitchel's pinwheel are not able to separate and stretch apart in order to provide increased directional aerodynamic stability and increased structural rigidity to the blades of the pinwheel as an automatic response to wind velocity. Consequently Mitchel's pinwheel does not work as a rotational kite tail. Increasing wind velocities cause it to wobble about, turn sideways, and bend. Consequently it doesn't have the desired quality of rotating faster with increased wind velocity.

Jackson, U.S. Pat. No. 3,936,020 and Busato, French patent 958,172 both suggest propeller-like elements for use as rotational kit tails. A propeller at the end of a string used as a kite tail tends to turn sideways and to fail to rotate. This is because it has very little elongation in the direction of the wind—very little directional stability. A string of propellers can be made so that each propeller is rigid enough and has a sufficiently long bearing surface about its axis of rotation that this string of propellers do rotate about the axis of a kite tail even in high winds. However propellers designed for high winds are too heavy for low winds. And propellers designed for low winds bend and deform in high winds. Propellers and pinwheels with fixed blade depth and bearing length tend to deform undesirably with increased wind velocity. They tend to become structurally unreliable and aerodynamically unstable. What is needed an desired is an inexpensive, light weight, rotational kite tail that is truly self regulating—one that automatically deforms in a desirable way as wind speeds increase to provide increased rigidity and directional stability as well as increased drag.

OBJECTIVE

One objective of this invention is to provide a rotating self regulating kite tail that is light weight, simple, inexpensive, and more effective as a stabilizer than prior art kite tails.

Another objective is to provide a kite tail that remains aerodynamically effective in providing self regulating drag when stressed in high wind; a kite tail the wind will not flatten out and render ineffective.

REFERENCE NUMBERS IN DRAWING

20 Diamond Kite
21 Aft portion of Kite
22 Kite Bridle and Tether for Diamond Kite
23 Delta Kite
24 Split Ring
30 Pinwheel Turbine
31 Unfolded Blank For Pinwheel Turbine
32 Attachment Clip
34 Attachment Clip
36 Ball and Pin Swivel Mechanism
40 String Segment
42 Two Pronged Attachment Clip
43 Cut
44 Spring Clip Swivel Mechanism
46 Vane Portion of Pinwheel Blade
48 Tab Portion of Pinwheel Blade
50 Hole in Tab of Blade
52 Hole at End of Cut 54 Hole in Leeward Face of Pinwheel for Leeward Grommet
55 Windward Grommet
56 Reinforcement Material
57 leeward Grommet
58 Elongated Spring Clip
60 Ball & Pin Swivel with Two Pronged Attachment Clip
62 Ball and Pin Swivel with Attachment Rings and Clip
64 Ball and Pin Chain Swivel with Split Ring Attachment Ring, and Two Prong Attachment Clip
66 Ball and Pin Chain Swivel
70 Tether and Keel for Delta Kite
71 Multi Pinwheel Kite Tail
72 Hollow Tube
74 String Knotted around Balloon
76 Balloon
78 String Knotted to Hole in Kite

DESCRIPTION OF THE INVENTION

Figure 1:
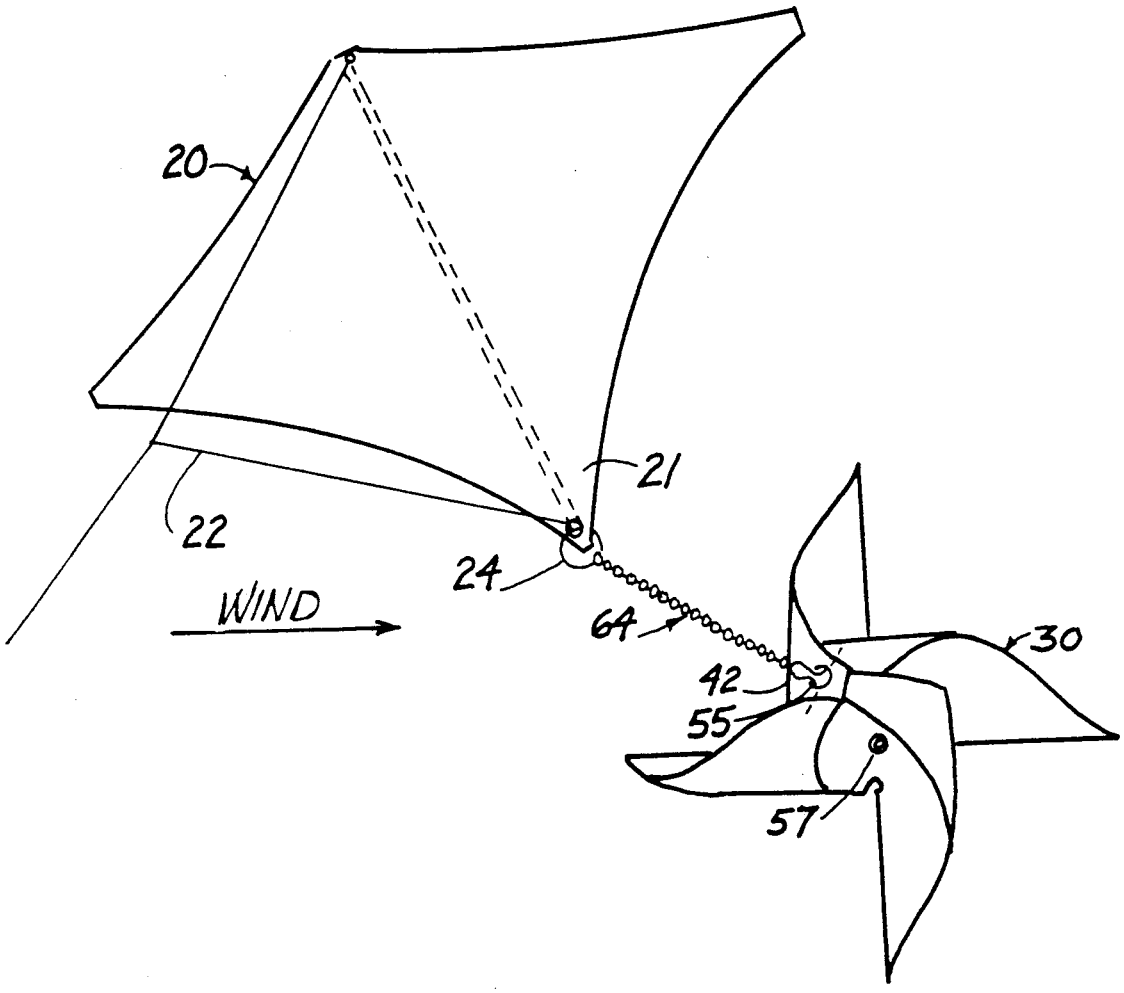
FIG. 1 is a perspective of a pinwheel turbine and swivel attached to a kite to create a kite tail.

FIG. 1 shows a diamond kite 20 flown from tether and bridle 22. Attachment ring 24 at one end of swivel mechanism 64 attaches to the aft portion of the kite 21. The swivel mechanism 64 trails in the wind leeward the kite and the two prong attachment clips 42 at the other end of swivel mechanism 64 inserts through the windward grommet 55 on the windward face of the pinwheel 30 at its central axis of rotation. Leeward grommet 57 is available for the attachment of an additional segment of kite tail.

Figure 2:
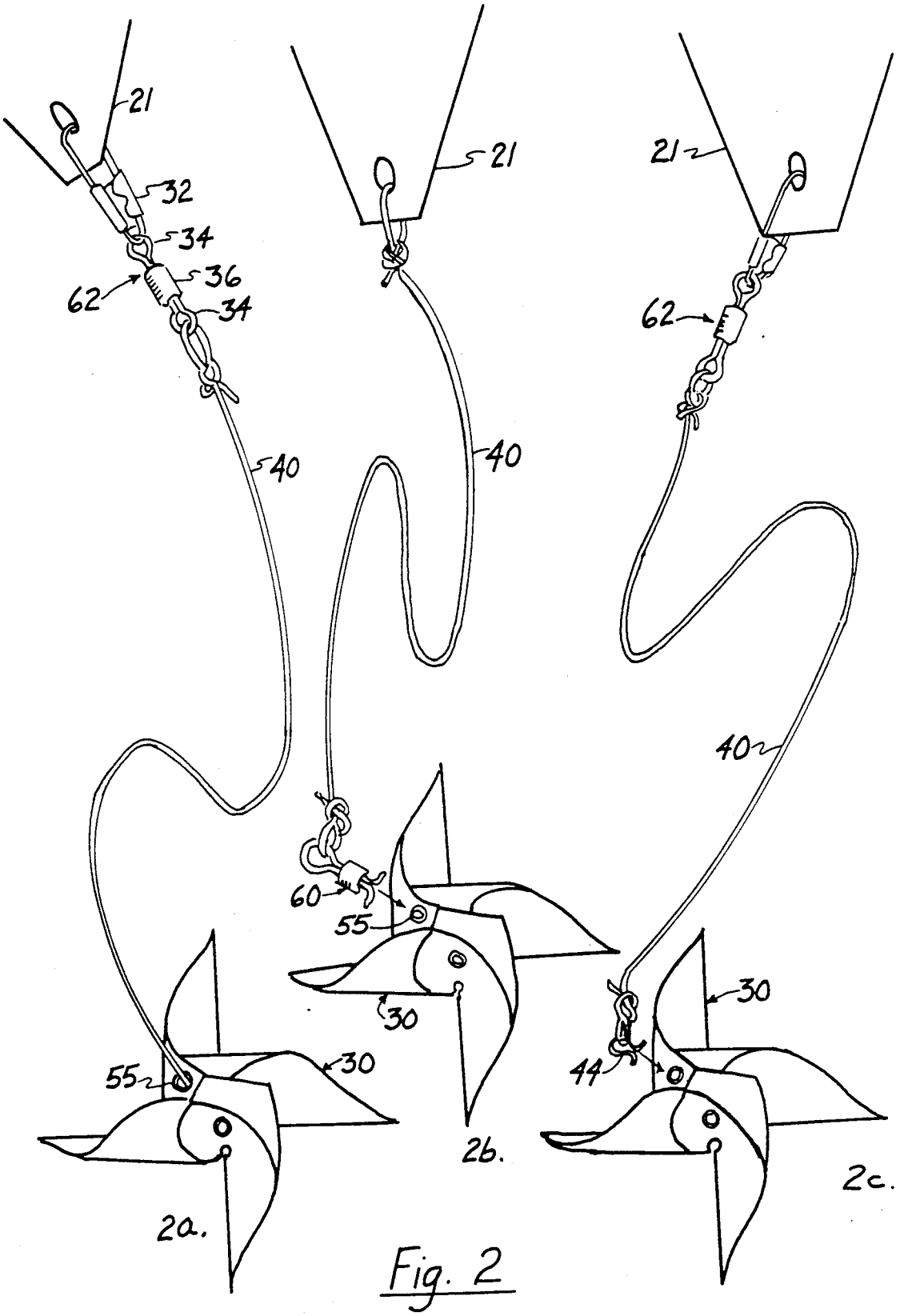
FIG. 2 is a detail showing three alternative configurations for extending the pinwheel away from the kite with a segment of string.

FIG. 2*a* shows string segment 40 used as means for extending the pinwheel 30 away from the kite by tying one end of string segment 40 to swivel mechanism 62 on the aft portion of the kite 21 and the other end to the windward grommet 55 on the windward face of pinwheel 30. FIG. 2*b* shows string segment 40 used as means for extending the pinwheel 30 away from the kite by tying one end of string segment 40 to the aft portion of the kite 21, and clipping the other end of string segment 40 to the windward grommet 55 in the windward face of the pinwheel 30 by means of swivel mechanism 60. FIG. 2*c* shows string segment 40 used as means for extending the pinwheel 30 away from the kite by attaching one end of string segment 40 to the aft portion of the kite 21 by means of swivel mechanism 62 and attaching the other end of string segment 40 to pinwheel 30 by means of spring clip swivel mechanism 44.

Figure 3:
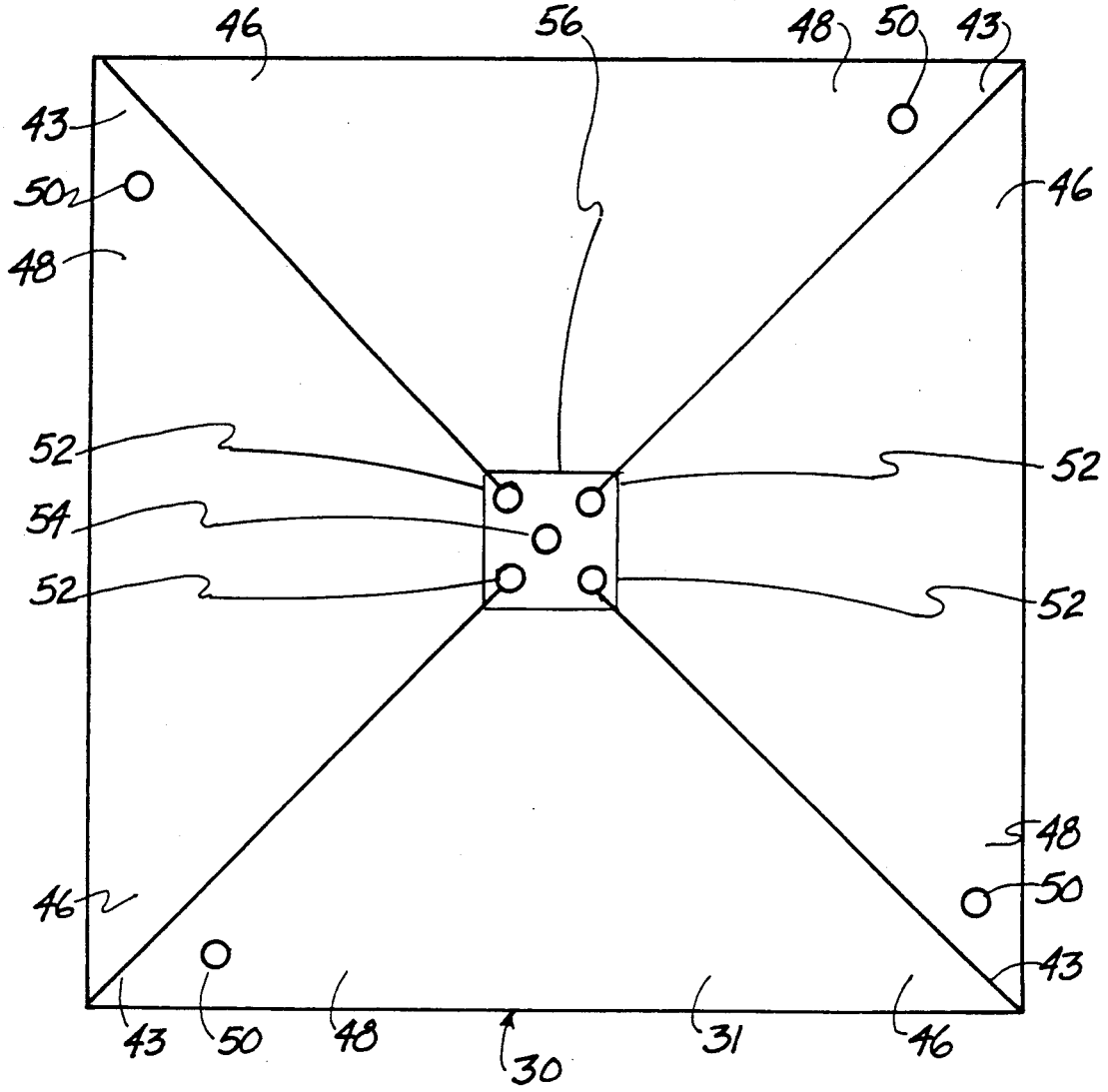
FIG. 3 is a plan view of an unfolded pinwheel.

FIG. 3 shows the unfolded blank 31 for the pinwheel 30 used in the invention. This is typically made from 5 to 10 mill metallized polyester film. Four cuts 43 divide the pinwheel into four blades. Four holes 52 are punched at the end of each cut to act as tearing stops, and four holes 50 are made in the tab areas of each blade. Hole 54 is made in the center of the blank 31 and the leeward reinforcing grommet is installed in this hole. Reinforcement material 56 is attached as shown covering that portion of blank 31 where the four holes 52 and hole 54 are punched into the blank 31. The area where the reinforcement material is located around hole 54 is identified as the leeward face of pinwheel 30. This reinforcement material is typically clear polyester tape or metallized tape with pressure sensitive adhesive. The blank 31 is folded into a pinwheel 30 by attaching each of the 4 tab areas 48 together by means of clamping windward grommet 55 through each of the 4 holes 50. The windward side of the 4 tab areas 48 is identified as the windward side of the pinwheel.

FIG. 4*a* through 4*e* shows a sampling of hardware that can be used as swivel mechanisms.

FIG. 4*a* is a round headed spring clip, FIG. 4*b* is spike headed spring clip. FIG. 4*c* shows swivel mechanism 60 consisting of an attachment ring 34, and ball and pin swivel 36 and a two pronged attachment clip 42. FIG. 4*d* shows a swivel mechanism consisting of a split ring 24, a light gage ball and pin chain 66 and a two pronged attachment clip 42. FIG. 4*e* is a swivel mechanism 64 consisting of an attachment clip 32, an attachment ring 34, a ball and pin swivel 36 and another attachment ring 34. These swivel mechanisms are typically made from thin metal or plastic.

Figure 5:
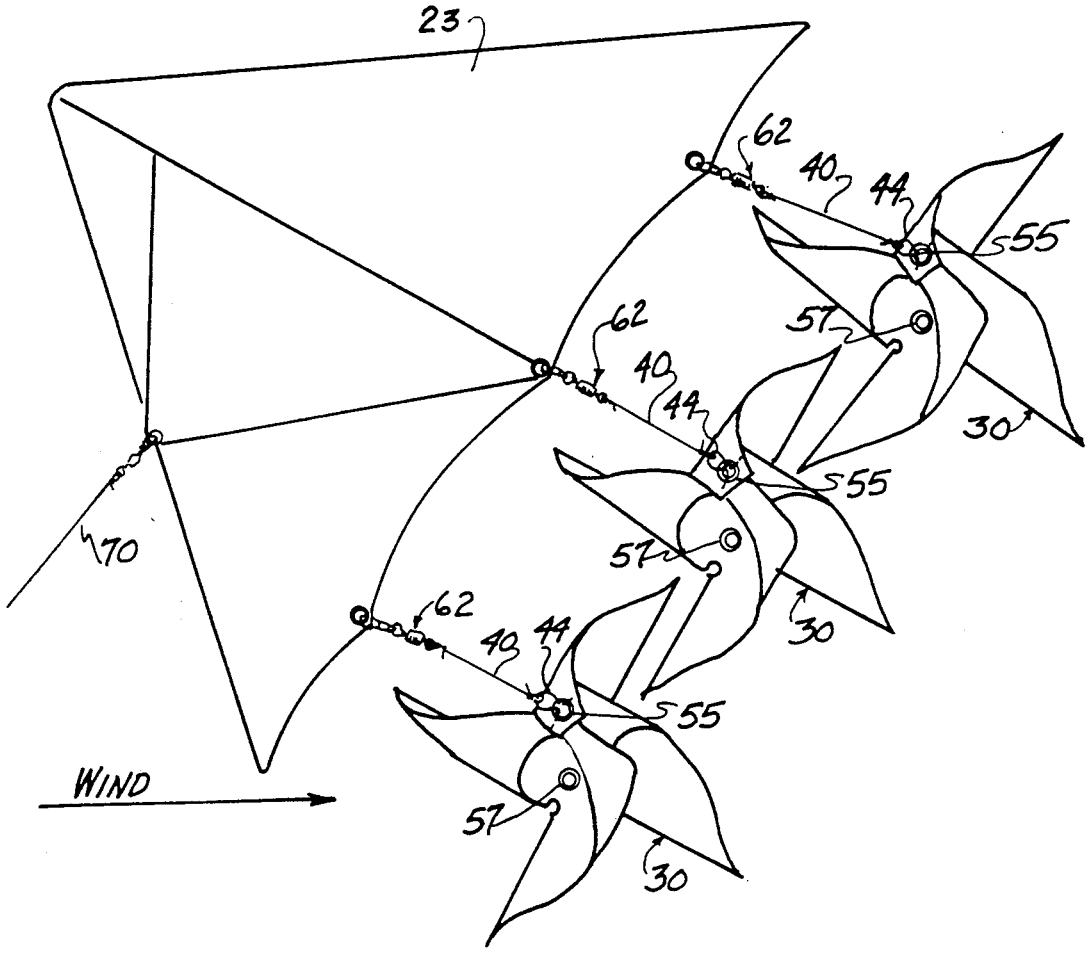
FIG. 5 is a perspective of a multiplicity of individual pinwheels used as kite stabilizers on one kite.

FIG. 5 shows a delta kite 23 flying from keel and bridle 70 having a multiplicity of pinwheels extended from the kite. Each pinwheel 30 is extended from the kite by a string segment 40 and by swivel mechanisms 62 and 44, as shown allowing it to trail off in the wind leeward the kite.

Figure 6:
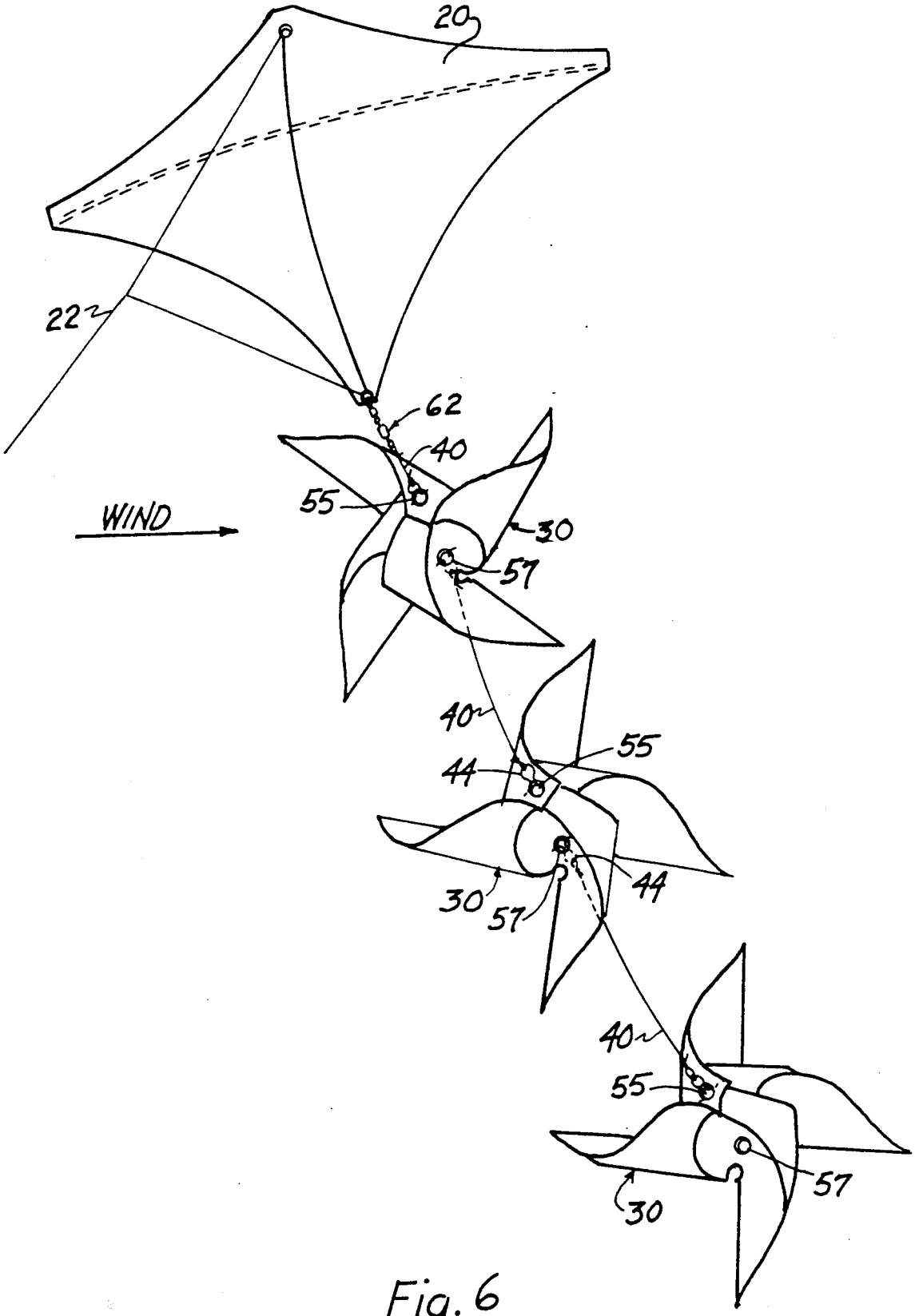
FIG. 6 is a perspective showing a kite stabilized by a single tail bearing a multiplicity of pinwheels.

FIG. 6 shows a diamond kite 20 flying from tether and bridle 22 stabilized by a compound kite tail 71. Kite tail 71 is made by linking pinwheel 30' to the leeward grommet 57 of pinwheel 30 by means of string segments 40' and spring clip 44' as illustrated.

Figure 4:
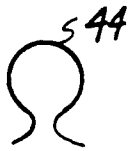
FIG. 4 is a detail showing alternative swivel hardware.
Figure 4:
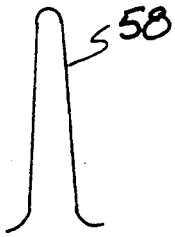
Figure 4:
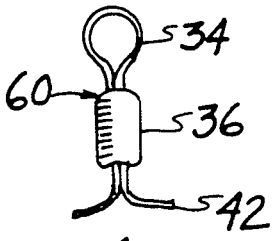
Figure 4:
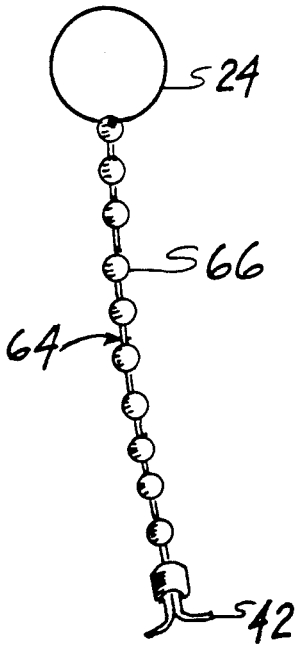
Figure 4:
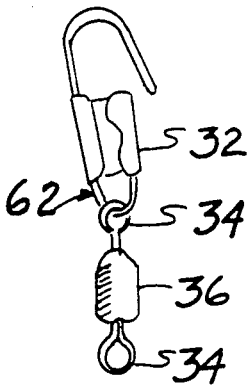
Figure 7:
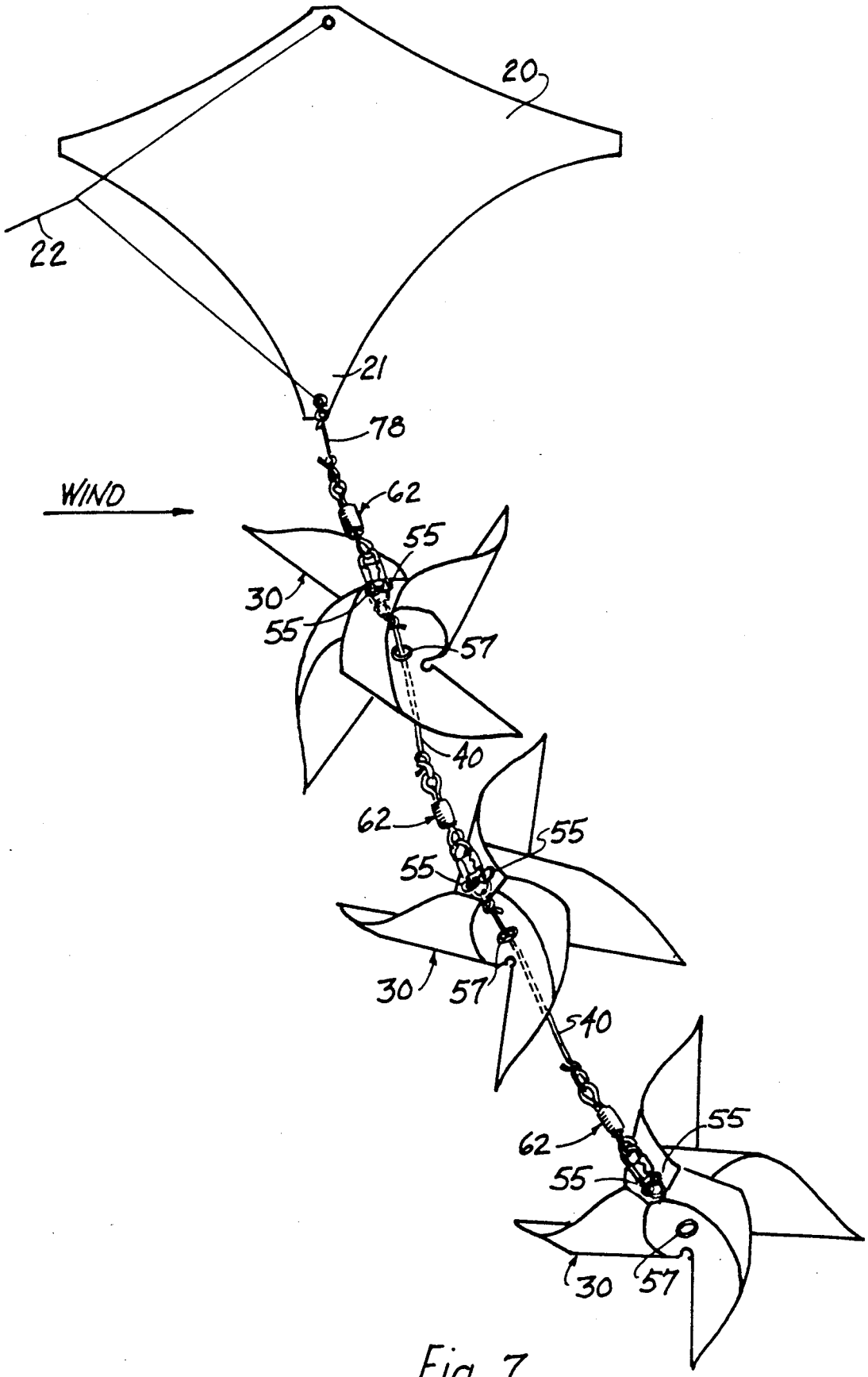
FIG. 7 is a perspective showing how to use the ball and pin swivel clip 62 of FIG. 4 to attach a string of pinwheel turbines in tandem.

FIG. 7 shows how to use the ball and pin swivel clip 62 of FIG. 4 to hook a multiplicity of the pinwheel turbines of FIG. 1 together in tandem. The most windward turbine 30 is tethered to the kite 20. The second turbine 30 by passing the windward swivel 62' of the second turbine's tether through the leeward grommet hole 57 on the most windward turbine 30 and attaching this windward swivel 62' to the leeward swivel 62 on the most windward turbines tether. Additional turbines may be likewise attached in tandem.

Figure 8:
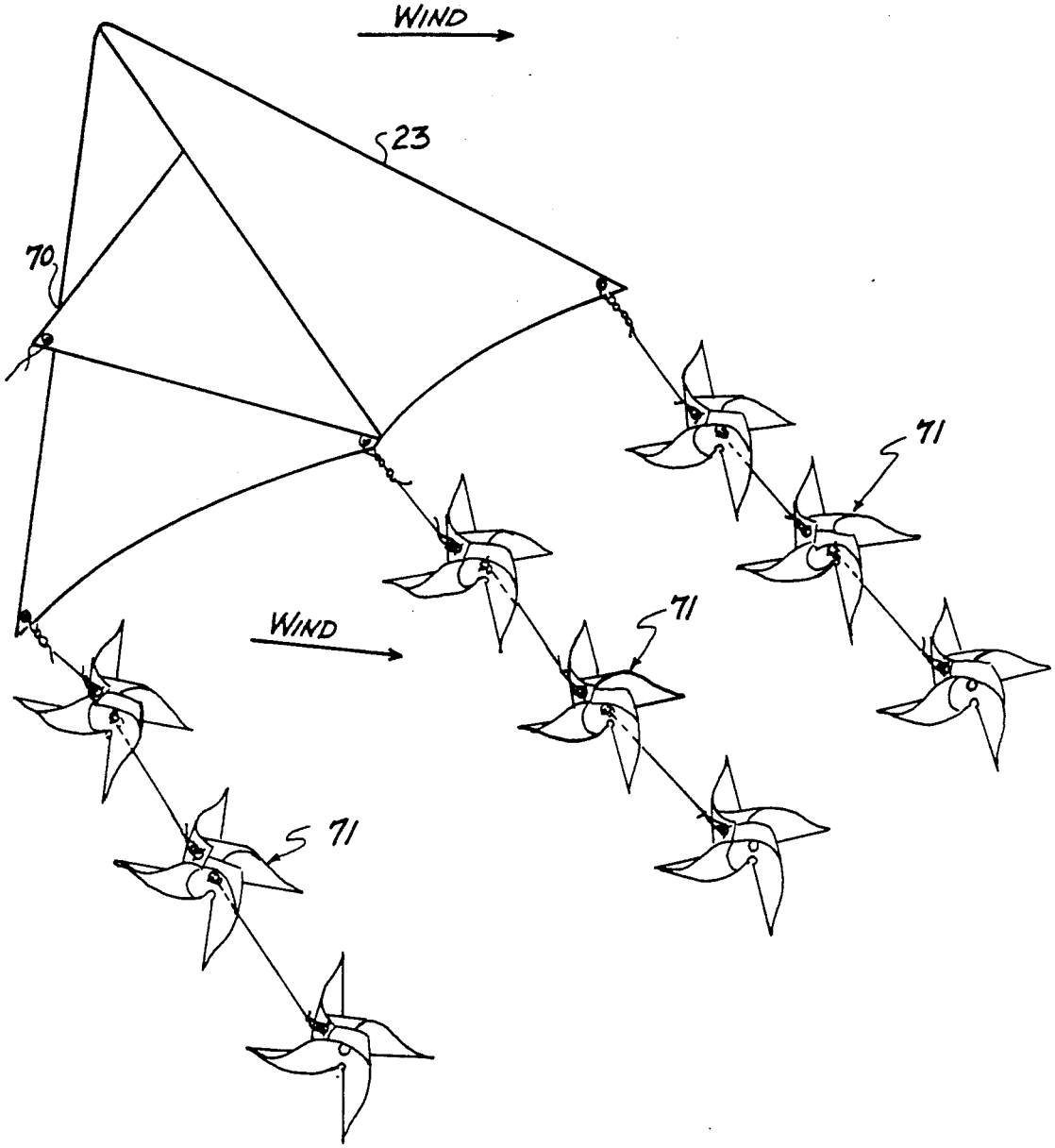
FIG. 8 shows a perspective where a plurality of multiple pinwheel stabilizers are used to stabilize a kite.

FIG. 8 shows a delta kite 23 flown from a tether and keel 70. A plurality of kite tails 71 each having a multiplicity of pinwheels attach in a manner allowing each of the kite tails to trail off in the wind leeward the delta kite 23.

FIG. 9 shows a diamond kite 20 flown from tether and bridle 22. A balloon 76 is tied to the leeward end of string segment 40 by means of knot 74. The windward end of the string is tied to the aft portion of the kite 21 by means of knot 78.

OPERATION OF THE INVENTION

FIG. 1 shows diamond kite 20 flying, from tether and bridle 22. Swivel mechanism 64 is held to the aft portion of the kite 21 by means of split ring 24. A two pronged clip 42 on the other end of swivel mechanism 64 attaches to windward grommet 55 centered in the windward face of pinwheel 30. Wind pressure against the pinwheel causes it to rotate and trail off leeward the kite. Wind pressure stresses the leeward face of the pinwheel 30 around leeward grommet 57 away from the tethered windward face of the pinwheel 30. This results in two unexpected operating characteristics. First this stress causes the pinwheels veins to bristle. This tension spreading the windward and leeward faces of the pinwheel, imparts structural stress to the pinwheels veins causing them to resist their tendency to bend in the wind. Second, this slight stretching apart of the windward and leeward faces of the pinwheel 30, together with the gyroscopic effects of spinning, imparts enough stability to keep the pinwheel spinning in a stable pattern substantially normal to the direction of the wind. The pinwheel spinning in the wind causes a tug against the aft portion of the kite 21 keeping the aft of the kite down and helping to prevent the kite from diving in gusty winds.

Presumably a tethered pinwheel has been heretofore thought of as too unstable to serve as a rotational kite tail. But attached as described herein—so the leeward face of the pinwheel is pulled away from the windward face—the pinwheel is both stable and extremely efficient as a rotating kite tale.

Each string segment 40 of FIG. 2*a* through 2*c* operates to extend the pinwheel away from and leeward the kite. This flexible extension helps to dampen the reaction between the kite and the pinwheel when the system is jerked around by erratic wind. This extension helps to further stabilize the flight system.

The pinwheel blank 31 is made into a pinwheel 30 by fastening each tab Portion 48 of Pinwheel blank 31 together by clamping each of the four holes 50 together with windward grommet 55. In practice reinforcement material 56 covering the four holes 52 and hole 54 adds many hours of operational life to the pinwheel at small additional expense. Leeward grommet 57 is typically installed in hole 54 to allow for adding additional pinwheel kite tails leeward the subject pinwheel 30.

Spring clip 44 of FIG. 4*a* and spring clip 58 of FIG. 4*b* are a light, inexpensive means for attaching a string to a pinwheel and providing a swivel mechanism. They allow the pinwheel to turn at its point of attachment to the string. The function of the rest of this sampling of useful hardware is well known.

FIG. 5 shows one of many possible configurations for attaching a multiplicity of pinwheel kite tails to a kite to stabilize it. The pinwheels 30 trail off leeward the kite providing a drag on the aft, leeward portion of the kite. This keeps the wind surface of the kite properly oriented in the wind stream.

FIG. 6 shows how pinwheels can be linked together in series to form a compound pinwheel kite tail to provide more drag and stabilization. Note, there are elements denoted by a number and denoted again by the same number and a prime, for example 44 and 44'. These are identical elements attached in series. In this way a large kite that generates a lot of lift can be stabilized by a few small pinwheels. A typical pinwheel 30' is linked to pinwheel 30 which is itself nearer the kite by means of a string segment 40 and a spring clip 44' as shown. Spring clip 44 and spring clip 44' pull in opposite directions on pinwheel 30 tending to spread the windward and leeward face of pinwheel 30. This spreading stress tends to make the pinwheel more rigid, more wind resistant, and more stable.

Obviously a number of pinwheels can be linked together like this in series to make a long compound kite tail. Note that the pinwheels rotate independently of one another. So it is possible to configure the pinwheels so some of them spin relatively clockwise while others spin relatively counterclockwise. This feature can be used to make the motion of the kite tail more balanced and more interesting to viewers.

FIG. 7 shows how the ball and pin swivel clip 62 of FIG. 4 can be used to hook a multiplicity of pinwheels of FIG. 1 to operate in tandem. The most windward turbine 30 is tethered to kite 20. Swivel 62' passes through grommet hole 57 on the leeward face of turbine 30 and attaches to swivel 62 tethering turbine 30' to turbine 30. Turbine 30 operates just as described above the turbine of FIG. 1. The tension of the tether attachment on the windward face of turbine 30 and the wind pressure on the leeward face of turbine 30 allow turbine 30 to elongate in proportion to the velocity of the wind. Turbine 30' together with other turbines in this tandem string likewise operate as described for the turbine of FIG. 1.

CONCLUSION

This single or multi pinwheel kite tail fills the need for a simple, economical, light weight, self regulating kite tail that can help keep a kite airborne in a wide range of wind speeds. The pinwheel kite tail is very light and provides a minimum amount of drag in low winds. As wind speeds increase the pinwheel provides proportionally more drag and stability. The kite is fastened to the windward face of the pinwheel by a swivel and extension means. This allows the wind to pull the leeward face of the pinwheel away from the windward face. This keeps the pinwheel surprisingly rigid and stable. This self regulating pinwheel kite tail is so efficient that is allows the host kite to be designed with a greater lift to weight ratio. The host kite can have a relatively wider wind span, and relatively lighter spars. So this invention actually improves the design possibilities and flight envelope for flying kites in variable wind. It is a simple matter to add balloons to this kite tail stabilization system for more color, motion, and visual interest.

While the above description contains many specifics, these should not be construed as limitations on the scope of the invention, but rather as an exemplification of the preferred embodiments thereof. Many other variations are possible. Accordingly, the scope of the invention should be determined not by the embodiments illustrated, but by the appended claims and their legal equivalents.

What is claimed is:

1. A stabilizing means capable of being attached to a kite said stabilizing means comprising:

a) a swivel means having oppositely disposed windward and leeward ends;

b) a pinwheel having spaced apart windward and leeward faces; wherein the first end of the swivel mechanism is attached by attachment means to said kite, and wherein the second end of the swivel means is attached by attachment means to the windward face of the pinwheel, said swivel means is attached in a manner which allows each stabilizer to trail off in the wind leeward said kite.

2. The stabilizing means of claim 1, wherein a flexible extension means having oppositely disposed ends is inserted between said kite and said swivel means, wherein one end of the extension means is attached by attachment means to said kite and the other end of the extension means is attached by attachment means to said swivel means.

3. The stabilizing means of claim 1, wherein a flexible extension means having oppositely disposed ends is inserted between the swivel means and said pinwheel having one end of the extension means attached by attachment means to said swivel means and the other end of the extension means attached by attachment means to said pinwheel.

4. The stabilizing means of claim 3, wherein the attachment means for attaching said pinwheel to the extension means is a second swivel means.

5. The stabilizing means of claim 2, 3, or 4, wherein the swivel means are ball and pin mechanisms.

6. The stabilizing means of claim 4, wherein the swivel means between the extension means and said pinwheel is a spring clip.

7. The stabilizing means of claims 2, 3, or 4, wherein the extension means is a string.

8. A stabilizing means capable of being attached to a kite said stabilizing means comprising:

a.) A multiplicity of swivel means each having oppositely disposed windward and leeward ends, and b.) A multiplicity of pinwheels each having spaced apart windward and leeward faces; wherein the first end of the first of the multiplicity of swivel means is attached by attachment means to the kite and the second end of the first swivel means is attached by attachment means to the windward face of the first of the multiplicity of pinwheels, wherein the first end of the second of the multiplicity of swivel means is attached by attachment means to the leeward face of the first pinwheel and attaches by attachment means to the second end of the first swivel means and the second end of the second swivel means is attached by attachment means to the windward face of the second of the multiplicity of pinwheels, and wherein each of the multiplicity of swivel means and pinwheels is likewise linked together in tandem allowing the stabilizing means to trail off in the wind leeward said kite.

* * * * *